US007209825B2

(12) United States Patent
Kimura et al.

(10) Patent No.: US 7,209,825 B2
(45) Date of Patent: Apr. 24, 2007

(54) CONTROL APPARATUS FOR INTERNAL COMBUSTION ENGINE

(75) Inventors: Koichi Kimura, Numazu (JP); Yoshiyuki Tanaka, Nagoya (JP); Katsutoshi Tanei, Aichi-gun (JP); Tomoyuki Uchiyama, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 66 days.

(21) Appl. No.: 11/292,079

(22) Filed: Dec. 2, 2005

(65) Prior Publication Data

US 2006/0136115 A1 Jun. 22, 2006

(30) Foreign Application Priority Data

Dec. 17, 2004 (JP) ..... 2004-366562

(51) Int. Cl.
*F01L 1/34* (2006.01)
*F02D 45/00* (2006.01)

(52) U.S. Cl. ..... 701/104

(58) Field of Classification Search ..... 701/104, 701/102, 110, 114; 123/90.15
See application file for complete search history.

(56) References Cited

U.S. PATENT DOCUMENTS 5,386,694 A * 2/1995 Ogawa et al. ..... 60/276
5,572,978 A * 11/1996 Ogawa ..... 123/491
2002/0092506 A1 7/2002 Fujiki et al.
2002/0129796 A1 9/2002 Shimizu

FOREIGN PATENT DOCUMENTS

| | | | |
|---|---|---|---|
| DE | 4 447 868 | | 4/2004 |
| EP | 0 536 001 | A1 | 4/1993 |
| EP | 0 626 511 | A2 | 11/1994 |
| JP | 08-261034 | | 10/1986 |
| JP | 2-78768 | A * | 3/1990 |
| JP | 11-036936 | | 2/1999 |
| JP | 2003-020965 | | 1/2003 |
| JP | 2003-120394 | | 4/2003 |

OTHER PUBLICATIONS

Notification dated Mar. 27, 2006; International Search Report; Written Opinion.

* cited by examiner

*Primary Examiner*—Hieu T. Vo
(74) *Attorney, Agent, or Firm*—Kenyon & Kenyon LLP

(57) ABSTRACT

A control apparatus for an internal combustion engine according to the invention obtains a first index that indicates the amount of fuel adhering to the wall surface of an intake passage, using intake valve timing; obtains a correction value that reduces the first index, using exhaust valve timing and the intake valve timing; and calculates a second index that indicates the amount of fuel adhering to the wall surface of the intake passage, using the correction value. The control apparatus controls the amount of fuel to be injected based on at least one of the first index and the second index.

15 Claims, 7 Drawing Sheets

CONTROL APPARATUS FOR INTERNAL COMBUSTION ENGINE

INCORPORATION BY REFERENCE

The disclosure of Japanese Patent Application No. 2004-366562 filed on Dec. 17, 2004 including the specification, drawings and abstract is incorporated herein by reference in its entirety.

BACKGROUND OF THE INVENTION

1. Field of the Invention

The invention relates to a control apparatus for an internal combustion engine where intake valve timing and exhaust valve timing can be adjusted and fuel is injected into an intake passage, which calculates an index that indicates the amount of fuel adhering to the wall surface of an intake passage based on the operating state of the engine, and controls the amount of fuel to be injected based on the index.

2. Description of the Related Art

In internal combustion engines where fuel is injected into an intake passage from a fuel injection valve, part of the injected fuel adheres to the wall surface of the intake passage. The amount of fuel adhering to the wall surface is not constant, and varies depending on the operating state of the internal combustion engine. Accordingly, when the amount of fuel adhering to the wall surface increases, the amount of fuel supplied to a combustion chamber is less than the amount of fuel injected from the fuel injection valve. When the amount of fuel adhering to the wall surface decreases, the amount of fuel supplied to the combustion chamber is greater than the amount of fuel injected from the fuel injection valve. As a result, the air-fuel ratio estimated based on the amount of injected fuel and the amount of intake air is deviated from the actual air-fuel ratio. This deviation of the estimated air-fuel ratio from the actual air-fuel ratio may cause problems relating to the output of the engine and exhaust gas discharged from the engine.

The amount of fuel adhering to the wall surface is greatly influenced by the valve overlap between the intake valve and the exhaust valve, which may cause exhaust gas to flow back to the intake passage. Therefore, in an internal combustion engine where the valve overlap can be adjusted, the deviation of the estimated air-fuel ratio from the actual air-fuel ratio needs to be prevented. Thus, for example, Japanese Patent Application Publication No. JP-A-11-36936 (hereinafter, referred to as No. 11-36936) and Japanese Patent Application Publication No. JP-A-8-261034 (hereinafter, referred to as No. 8-261034) describe control apparatuses which estimate an index that indicates the amount of fuel adhering to the wall surface of an intake passage based on the valve overlap amount, and an advance angle of the intake valve timing corresponding to the valve overlap amount; and correct the amount of fuel to be injected based on the amount of fuel adhering to the wall surface of the intake passage.

However, the control apparatuses described in No. 11-36936 and No. 8-261034 execute the control on the assumption that only the intake valve timing is adjusted, and the exhaust valve timing is not adjusted. Therefore, consideration is not given to the influence of the valve timing on the amount of fuel adhering to the wall surface of the intake passage in the case where both the intake valve timing and the exhaust valve timing can be changed even when the overlap amount remains the same.

The intake valve timing and the exhaust valve timing are physical quantities different from each other. Thus, in the case where the technologies described in No. 11-36936 and No. 8-261034 are applied to the internal combustion engine where both the intake valve timing and the exhaust valve timing are adjusted, the behavior of the amount of fuel adhering to the wall surface of the intake passage may be different from the estimated behavior, which reduces the accuracy in controlling the amount of fuel to be injected.

SUMMARY OF THE INVENTION

A first aspect of the invention relates to a control apparatus for an internal combustion engine, which includes a calculation portion and a control portion. The calculation portion obtains a first index that indicates the amount of fuel adhering to the wall surface of an intake passage, using intake valve timing, based on a first relation that is set between the intake valve timing and the first index under the condition that exhaust valve timing is fixed. The calculation portion obtains a correction value that reduces the first index, using the exhaust valve timing and the intake valve timing, based on a second relation that is set among the exhaust valve timing, the intake valve timing and the correction value under the condition that the exhaust valve timing is not fixed. The calculation portion calculates a second index that indicates the amount of fuel adhering to the wall surface of the intake passage, by correcting the first index using the correction value. The control apparatus controls the amount of fuel to be injected based on at least one of the first index and the second index.

The intake valve timing has greater influence on the amount of fuel adhering to the wall surface of the intake passage than the exhaust valve timing. Therefore, the appropriate second index can be obtained by calculating the first index that indicates the amount of fuel adhering to the wall surface of the intake passage using the intake valve timing, and correcting the first index using the correction value that is obtained based on the relation among the exhaust valve timing, the intake valve timing and the correction value.

Accordingly, the calculation portion calculates the second index by correcting the first index calculated based on the first relation, using the correction value calculated based on the second relation.

With this configuration, the appropriate second index can be obtained. As a result, in the internal combustion engine where both the intake valve timing and the exhaust valve timing can be changed, the amount of fuel to be injected can be accurately controlled according to the change in the amount of fuel adhering to the wall surface of the intake passage, using the second index.

BRIEF DESCRIPTION OF THE DRAWINGS

The foregoing and/or further objects, features and advantages of the invention will become more apparent from the following description of example embodiment with reference to the accompanying drawings, in which the same or corresponding portions are denoted by the same reference numerals and wherein.

DETAILED DESCRIPTION OF THE EXEMPLE EMBODIMENTS

In the following description, the present invention will be described in more detail in terms of example embodiments.

Figure 1:
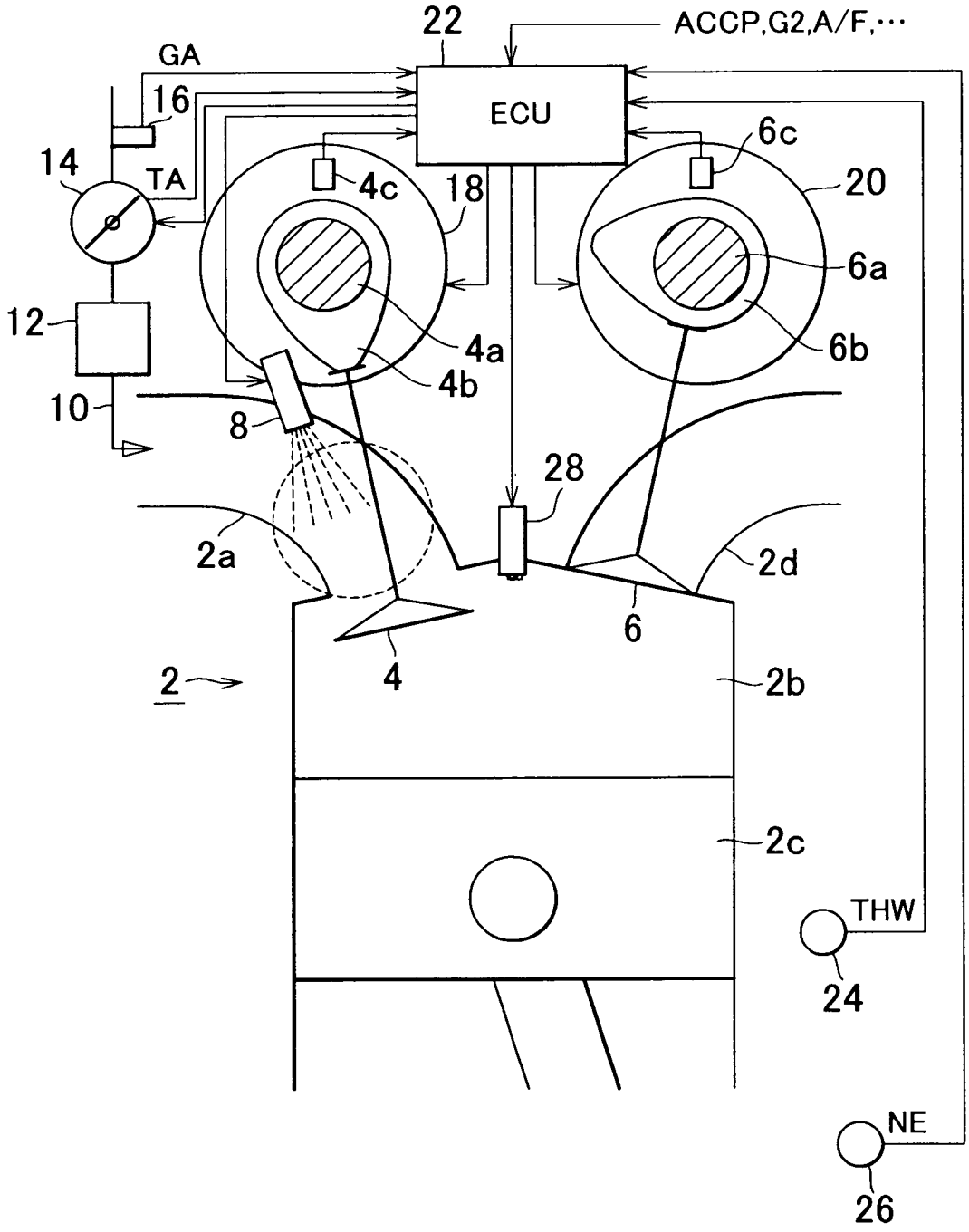
FIG. 1 illustrates the configuration of the main portion of an engine for a vehicle to which a control apparatus for an internal combustion engine according to a first embodiment of the invention is applied.

A first embodiment of the invention will be described. FIG. 1 schematically illustrates the configuration of the main portion of an engine 2 for a vehicle to which the invention is applied. The engine 2 is a 4-cycle gasoline internal combustion engine having a plurality of cylinders. An intake valve 4 in each cylinder is opened/closed by the rotation of an intake cam 4*b* provided on an intake cam shaft 4*a*. An exhaust valve 6 in each cylinder is opened/closed by the rotation of an exhaust cam 6*b* provided on an exhaust cam shaft 6*a*. Although FIG. 1 shows a direct-acting valve system, a rocker-arm valve system may be employed.

Fuel is injected into intake air in an intake port 2*a* from a fuel injection valve 8 provided in the intake port 2*a*. The intake port 2*a* is part of the intake passage. Intake air is distributed to the intake port 2*a* of each cylinder from a surge tank 12 provided in an intake passage 10 that is schematically shown in FIG. 1. The intake passage 10 is part of the entire intake passage. The amount of air taken into the entire engine 2 is adjusted by adjusting the opening amount of a throttle valve 14 that is provided upstream of the surge tank 12 (hereinafter, the opening amount will be referred to as "throttle valve opening amount TA"). An intake air amount sensor 16 provided in the intake passage 10 detects the amount of air taken into the entire engine 2 (hereinafter, referred to as "intake air amount GA").

Air-fuel mixture is supplied into a combustion chamber 2*b* from the intake port 2*a* by opening/closing the intake valve 4 and the exhaust valve 6. When an ignition plug 28 ignites the air-fuel mixture, a piston 2*c* is pushed downward due to combustion. After the combustion, exhaust gas in the combustion chamber 2*b* is discharged to an exhaust port 2*d*. Then, the exhaust gas is discharged to the atmosphere via an exhaust gas control catalyst and the like.

The intake cam 4*b* and the exhaust cam 6*b* open/close the intake valve 4 and the exhaust valve 6, respectively. The intake cam 4*b* and the exhaust cam 6*b* are provided on the intake cam shaft 4*a* and the exhaust cam shaft 6*a*, respectively. The intake cam shaft 4*a* and the exhaust cam shaft 6*a* are provided with variable valve timing mechanisms 18 and 20, respectively. Each of the variable valve timing mechanisms 18 and 20 includes a timing sprocket. The variable valve timing mechanism 18 adjusts the phase difference between the timing sprocket and the intake cam shaft 4*a*. The variable valve timing mechanism 20 adjusts the phase difference between the timing sprocket and the exhaust cam shaft 6*a*. Each sprocket is connected to the crankshaft using a timing chain.

The variable valve timing mechanism 18 for the intake valve 4 can advance the rotational phase of the intake cam shaft 4*a* with respect to a reference crank angle. The intake cam shaft 4*a* is rotated in accordance with the crankshaft. The rotational speed of the intake cam shaft 4*a* is half of that of the crankshaft. The variable valve timing mechanism 20 for the exhaust valve 6 can retard the rotational phase of the exhaust cam shaft 6*a* with respect to the reference crank angle. The exhaust cam shaft 6*a* is rotated in accordance with the crankshaft. The rotational speed of the exhaust cam shaft 6*a* is half of that of the crankshaft. As a result, the period during which the intake valve 4 is open and the period during which the exhaust valve 6 is open can be advanced or retarded. Therefore, the valve overlap amount can be adjusted, and the valve overlap position can be advanced or retarded. Such valve timing is changed based on the value detected by each of cam angle sensors 4*c* and 6*c*.

An electronic control unit (hereinafter, referred to as "ECU") 22 that controls an engine 2 having the aforementioned configuration receives the values indicating the operating state of the engine from the cam angle sensors 4*c* and 6*c*, and the intake air amount sensor 16. In addition, the ECU 22 receives the values indicating the operating state of the engine from a coolant temperature sensor 24 and an engine rotational sensor 26. The coolant temperature sensor 24 detects an engine coolant temperature THW. The engine rotational sensor 26 detects an engine rotational speed NE based on the rotational speed of the crankshaft. Further, the ECU 22 receives the values indicating the operating state of the engine such as the throttle valve opening amount TA, an accelerator pedal operation amount ACCP, a reference crank angle G2, and an air/fuel ratio A/F.

The ECU 22 executes various controls based on the detected values indicating the operating state of the engine. That is, the ECU 22 executes a fuel injection amount control and a fuel injection timing control for a fuel injection valve 8; a throttle valve opening amount control for the throttle valve 14, an ignition timing control for the ignition plug 28, and the like.

Figure 2:
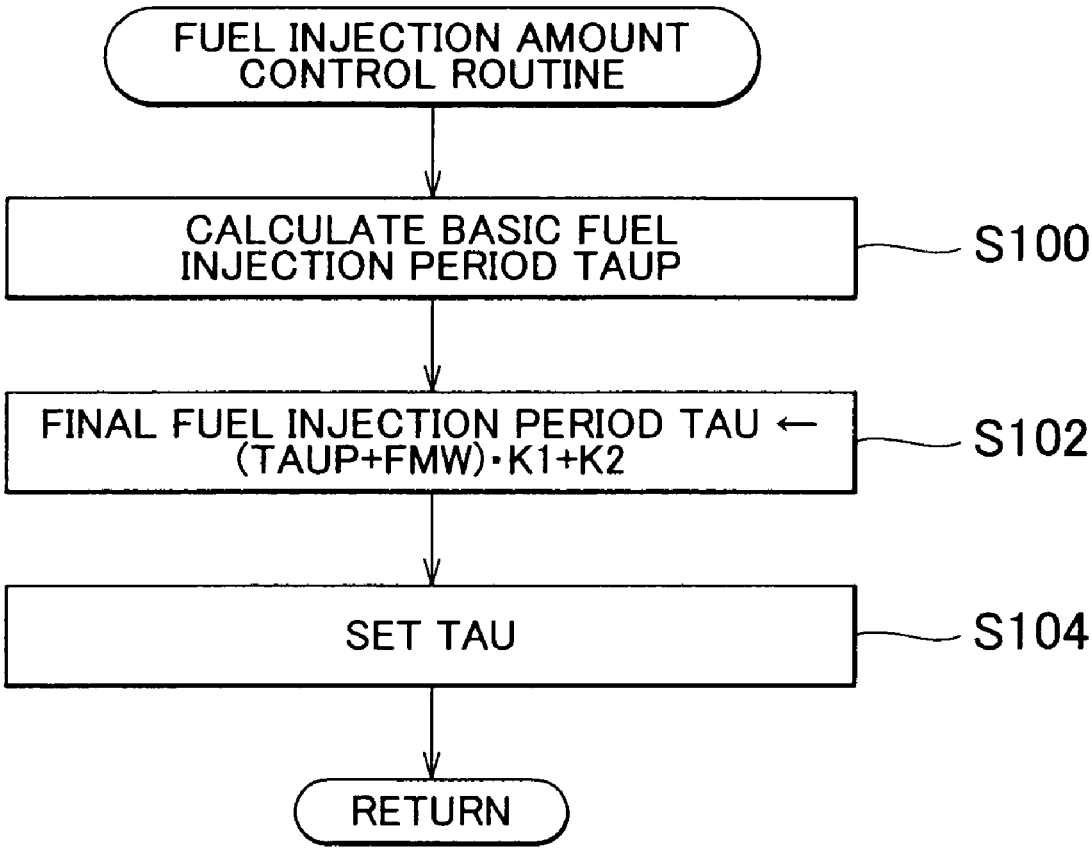
FIG. 2 illustrates the flowchart of a fuel injection amount control routine according to the first embodiment.

The fuel injection amount control routine that is executed by the ECU 22 in this embodiment will be described. FIG. 2 illustrates the flowchart of the fuel injection amount control routine. For example, in an engine having four cylinders, this fuel injection amount control routine is periodically executed every time the crankshaft is rotated by 180 degrees.

When the fuel injection amount control routine is started, a basic fuel injection period TAUP is calculated based on the intake air amount GA and the engine rotational speed NE (step S100). For example, the basic fuel injection period TAUP is calculated based on a map where the intake air amount GA and the engine rotational speed NE are used as parameters, or an equation.

Next, a final fuel injection period TAU is calculated based on an equation 1 (step S102).

$$TAU \leftarrow (TAUP+FMW)\cdot K1+K2 \quad (1)$$

In this equation (1), a correction coefficient K1 and a correction amount K2 are determined in advance, or determined based on the operating state of the engine. A wall adhesion correction amount FMW is calculated by a wall adhesion correction amount calculation routine shown in FIG. 3 that will be described later.

The final fuel injection period TAU is set to the calculated value so that fuel is injected from the fuel injection valve 8 for the final fuel injection period TAU at fuel injection timing that is calculated by another control routine (not shown)(step S104). Then, this routine is terminated. Subsequently, this fuel injection amount control routine is repeatedly executed at the aforementioned time intervals, whereby fuel is injected from the fuel injection valve 8 according to the operating state of the engine.

The wall adhesion correction amount calculation routine shown in FIG. 3 will be described. This routine and the aforementioned fuel injection amount control routine (FIG. 2) are repeatedly executed at the same time intervals. When the wall adhesion correction amount calculation routine is executed, first, a first index indicating the amount of fuel adhering to the wall surface of the intake port 2*a* (hereinafter, referred to as "basic wall adhesion amount QMWin") is calculated based on the intake valve timing INvvt using a QMWin map shown in FIG. 4 (step S150). The intake valve timing INvvt is expressed as the crank angle by which the intake valve timing is advanced with respect to the reference crank angle. The basic wall adhesion amount QMWin is the amount of fuel adhering to the wall surface per unit time (equivalent to the fuel injection period).

This QMWin map includes data that is obtained by actually measuring the amounts of fuel adhering to the wall surface of the intake port 2*a* at several load factors KL under the condition that the exhaust valve timing EXvvt is fixed to "0". The exhaust valve timing EXvvt is expressed as the crank angle by which the exhaust valve timing is retarded with respect to the reference crank angle. Alternatively, the QMWin map includes data that is obtained by estimating the amounts of fuel adhering to the wall surface of the intake port 2*a* at several load factors KL, according to the intake valve timing INvvt, based on the relation between the amount of injected fuel and the air-fuel ratio of exhaust gas. This QMWin map corresponds to the first relation according to the invention. The load factor KL indicates the proportion of the present engine load to the maximum engine load. For example, the load factor KL is obtained based on a map where the accelerator pedal operation amount ACCP and the engine rotational speed NE are used as parameters.

Figure 4:
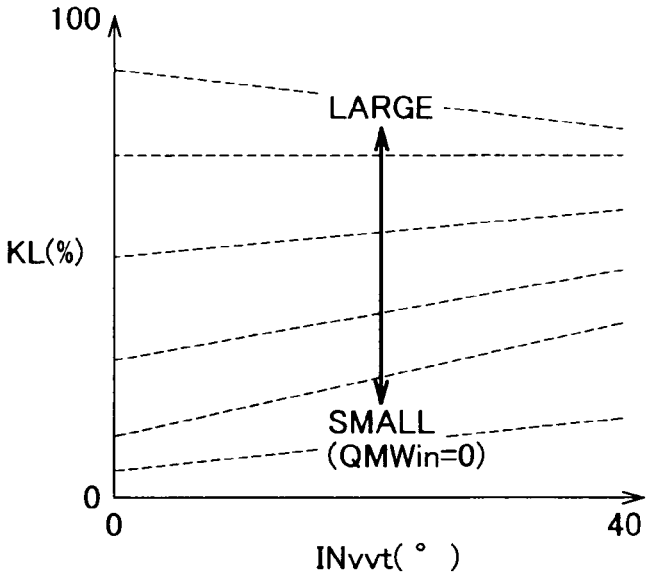
FIG. 4 illustrates a diagram explaining the configuration of a QMWin map according to the first embodiment.

In the QMWin map shown in FIG. 4, in the case where the load factor KL is low, the basic wall adhesion amount QMWin decreases as the crank angle indicating the intake valve timing INvvt increases. In the case where the load factor KL is high, the basic wall adhesion amount QMWin increases as the crank angle indicating the intake valve timing Invvt increases. The basic wall adhesion amount QMWin in the case where the load factor KL is high is greater than that in the case where the load factor KL is low.

Figure 5:
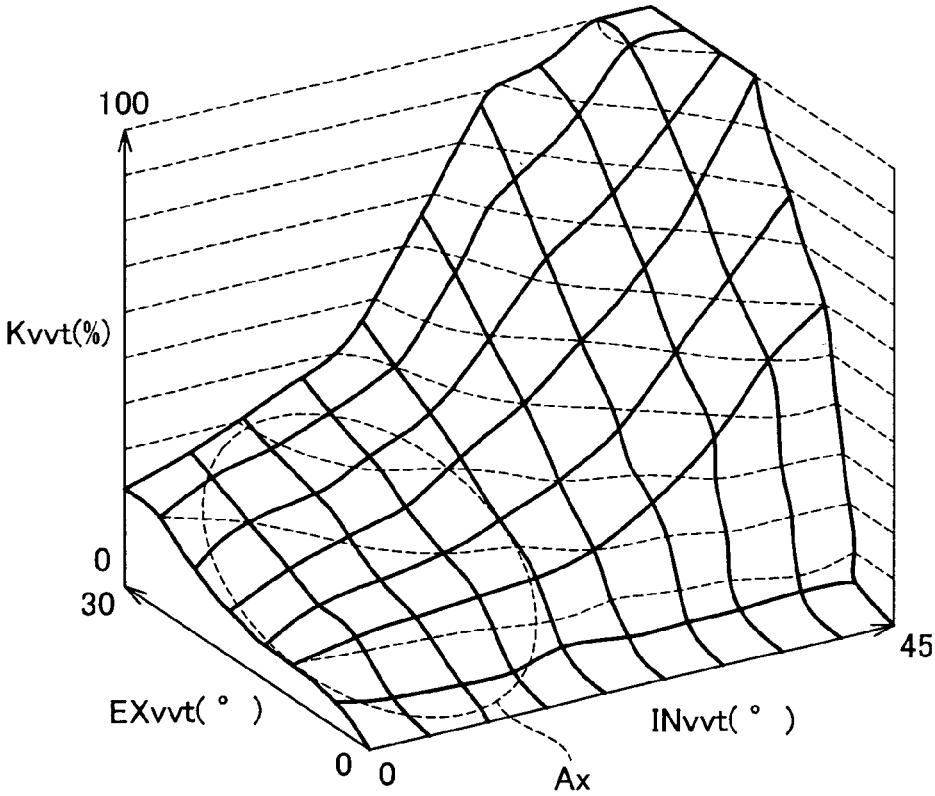
FIG. 5 illustrates a diagram explaining the configuration of a Kvvt map according to the first embodiment.

Next, a reduction coefficient Kvvt is calculated using a three-dimensional Kvvt map shown in FIG. 5 (step S152). This reduction coefficient Kvvt corresponds to the correction value according to the invention. The Kvvt map corresponds to the second relation.

As shown in FIG. 5, the Kvvt map is employed to calculate the reduction coefficient Kvvt using the intake valve timing INvvt and the exhaust valve timing EXvvt as parameters. In the Kvvt map, the reduction coefficient Kvvt becomes approximately 0% in a region where the crank angle indicating the intake valve timing INvvt is small (i.e., in a region Ax surrounded by a dashed oval in FIG. 5 and around the region Ax). In the example shown in FIG. 5, in the region Ax, the crank angle indicating the intake valve timing INvvt is 0 to 20 degrees. That is, the lower limit of the intake valve timing INvvt is 0 degree. The upper limit of the intake valve timing INvvt may be 10 to 20 degrees. In the region where the crank angle indicating the intake valve timing INvvt is greater than 20 degrees, the reduction coefficient Kvvt greatly varies depending on the exhaust valve timing EXvvt.

Figure 6:
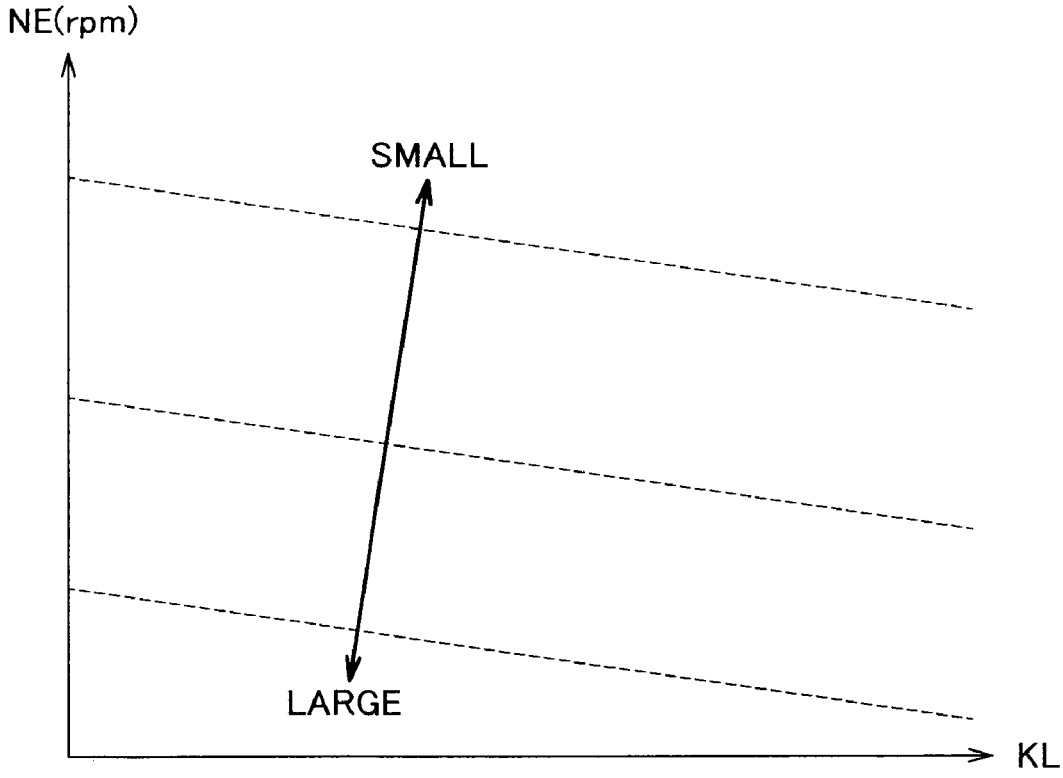
FIG. 6 illustrates a diagram explaining the configuration of a Kne map according to the first embodiment.

Next, a rotation correction coefficient Kne is calculated based on a Kne map shown in FIG. 6 (step S154). The Kne map is employed to calculate the rotation correction coefficient Kne using the engine rotational speed NE and the load factor KL as parameters. The rotation correction coefficient Kne is set to a value in the range of 1 to 0. The rotation correction coefficient Kne is set to be decreased as the engine rotational speed NE increases. The rotation correction coefficient Kne is set to be slightly decreased as the load factor KL increases. The Kne map may be a one-dimensional map where the engine rotational speed NE is used as a parameter, and the load factor KL is not used as a parameter.

Next, a wall adhesion amount QMWinex is calculated according to an equation (2) described below (step S156). The wall adhesion amount QMWinex is another index indicating the amount of fuel adhering to the wall surface of the intake port 2*a* based on the intake valve timing INvvt and the exhaust valve timing EXvvt. The wall adhesion amount QMWinex corresponds to the second index according to the invention.

$$QMWinex \leftarrow QMWin \cdot (1 - Kvvt \cdot Kne) \quad (2)$$

The value of "Kvvt·Kne" is equal to or less than 1, and is equal to or greater than 0 ($1 \geqq Kvvt \cdot Kne \geqq 0$). Therefore, as apparent from the equation (2), the wall adhesion amount QMWinex is set to be equal to or less than the basic wall adhesion amount QMWin, using the reduction coefficient Kvvt and the rotation correction coefficient Kne.

Next, a wall adhesion correction amount FMW is calculated based on the difference between the present wall adhesion amount QMWinex and a last time wall adhesion amount QMWinexold that is obtained when the wall adhesion correction amount calculation routine is executed last time, according to an equation (3) described below (S158).

$$FMW \leftarrow QMWinex - QMWinexold \quad (3)$$

Next, the last time wall adhesion amount QMWinexold is set to the present wall adhesion amount QMWinex (step S160). Then, the wall adhesion correction amount calculation routine is terminated.

By repeatedly executing the aforementioned routine, the wall adhesion correction amount FMW that indicates the change in the wall adhesion amount QMWinex is repeatedly calculated. The wall adhesion correction amount FMW is used to correct the basic fuel injection period TAUP when the final fuel injection period TAU is calculated according to the equation (1) (step S102) in the fuel injection amount control routine (FIG. 2). This corrects the amount of fuel to be injected from the fuel injection valve 8 according to the change in the amount of fuel adhering to the wall surface of the intake port 2*a*. As a result, the air-fuel ratio of the air-fuel mixture in the combustion chamber 2*b* can be made equal to a desired air-fuel ratio.

In the aforementioned configuration, the processes in steps S150 to s156 of the wall adhesion correction amount calculation routine (FIG. 3) correspond to the processes performed by the calculation means according to the invention.

According to the first embodiment that has been described, the following effects can be obtained.

In the wall adhesion correction amount calculation routine (FIG. 3), the basic wall adhesion amount QMWin is corrected using the reduction coefficient Kvvt to obtain the wall adhesion amount QMWinex. The basic wall adhesion amount QMWin is calculated according to the equation (2) using the QMWin map (FIG. 4). The reduction coefficient Kvvt is calculated using the Kvvt map (FIG. 5). Then, the wall adhesion correction amount FMW is calculated using the wall adhesion amount QMWinex. In the fuel injection amount control routine (FIG. 2), the final fuel injection period TAU is obtained by correcting the basic fuel injection period TAUP using the wall adhesion correction amount FMW.

Thus, the basic wall adhesion amount QMWin is calculated based on the intake valve timing INvvt using the QMWin map, and the basic wall adhesion amount QMWin is corrected using the reduction coefficient Kvvt that is calculated based on the intake valve timing and the exhaust valve timing EXvvt using the Kvvt map.

In the engine 2 where both the intake valve timing and the exhaust valve timing are adjusted, the influence of the exhaust valve timing on the amount of fuel adhering to the wall surface of the intake port 2*a* in the case where the crank angle indicating the intake valve timing INvvt is small is different from that in the case where the crank angle indicating the intake valve timing INvvt is large.

That is, in the case where the crank angle indicating the intake valve timing INvvt is small, the influence of the exhaust valve timing EXvvt on the amount of fuel adhering to the wall surface of the intake port 2*a* is small. Meanwhile, in the case where the crank angle indicating the intake valve timing INvvt is large, the influence of the exhaust valve timing EXvvt on the amount of fuel adhering to the wall surface of the intake port 2*a* is great.

In the engine 2 where both the intake valve timing INvvt and the exhaust valve timing EXvvt are adjusted, there is the specific relation between the amount of fuel adhering to the wall surface of the intake port 2*a*, and the intake valve timing INvvt and the exhaust valve timing EXvvt. That is, the intake valve timing INvvt has greater influence on the amount of fuel adhering to the wall surface of the intake port 2*a* than the exhaust valve timing EXvvt.

Because the intake valve timing INvvt has greater influence on the amount of fuel adhering to the wall surface of the intake port 2*a* than the exhaust valve timing EXvvt, the wall adhesion amount QMWinex that is calculated according to the equation (2) is the appropriate index.

The fuel injection amount control routine (FIG. 2) is executed based on the wall adhesion amount QMWinex. With this configuration, the amount of fuel to be injected can be accurately controlled according to the change in the amount of fuel adhering to the wall surface of the intake port 2*a* in the engine 2 where both the intake valve timing INvvt and the exhaust valve timing EXvvt can be changed.

Further, the exhaust valve timing EXvvt has almost no influence on the amount of fuel adhering to the wall surface of the intake port 2*a* in the case where the crank angle indicating the intake valve timing INvvt is small and is in a predetermined range.

Thus, the Kvvt map in FIG. 5 that shows the relation between the amount of fuel adhering to the wall surface of the intake port 2*a*, and the intake valve timing INvvt and the exhaust valve timing EXvvt is set as follows.

In the region Ax where the crank angle indicating the intake valve timing INvvt is small and around the region Ax, the reduction coefficient Kvvt is approximately "0", irrespective of the exhaust valve timing EXvvt. That is, in the region Ax and around the region Ax, the reduction coefficient Kvvt is not greatly changed due to the change in the exhaust valve timing EXvvt. The crank angle indicating the intake valve timing INvvt in the region Ax and around the region Ax is set to be in the range of 0 to 20 degrees.

Meanwhile, in the region where the crank angle indicating the intake valve timing INvvt is large, the reduction coefficient Kvvt is greatly changed according to the change in the exhaust valve timing EXvvt. The reduction coefficient is set to be in the range of approximately 0 to 1.

Because the Kvvt map shown in FIG. 5 is made in this manner, the wall adhesion amount QMWinex can be obtained more appropriately in the engine 2. Accordingly, based on the wall adhesion amount QMWinex, the amount of fuel to be injected can be accurately controlled according to the change in the amount of fuel adhering to the wall surface of the intake port 2*a*.

Further, when the wall adhesion amount QMWinex is calculated according to the equation (2), not only the reduction coefficient Kvvt but also the rotation correction coefficient Kne is used. The rotation correction coefficient Kne is obtained based on the engine rotational speed NE and the load factor KL. That is, by correcting the reduction coefficient Kvvt using the rotation correction coefficient Kne, it is possible to take into account the influence of the engine rotational speed NE on the amount of fuel adhering to the wall surface of the intake port 2*a* when the load factor KL is changed. Therefore, the wall adhesion amount QMWinex can be obtained even more appropriately. As a result, the amount of fuel to be injected can be executed even more accurately according to the change in the amount of fuel adhering to the wall surface of the intake port 2*a*.

A second embodiment of the invention will be described. In the second embodiment, a Kvvt map different from the Kvvt map in the first embodiment (FIG. 5) is used. The Kvvt map in the second embodiment does not include data concerning the region Ax and around the region Ax, in the first embodiment. To determine the region corresponding to the region Ax and around the region Ax, in the first embodiment, a boundary crank angle θx indicating the intake valve timing is set so as to be a boundary between the region corresponding to the region Ax and around the region Ax, and the other region. In this case, the boundary crank angle θx is 20 degrees. Only when the crank angle indicating the intake valve timing INvvt is greater than the boundary crank angle θx (INvvt>θx), the same processes as in the first embodiment are executed.

Figure 7:
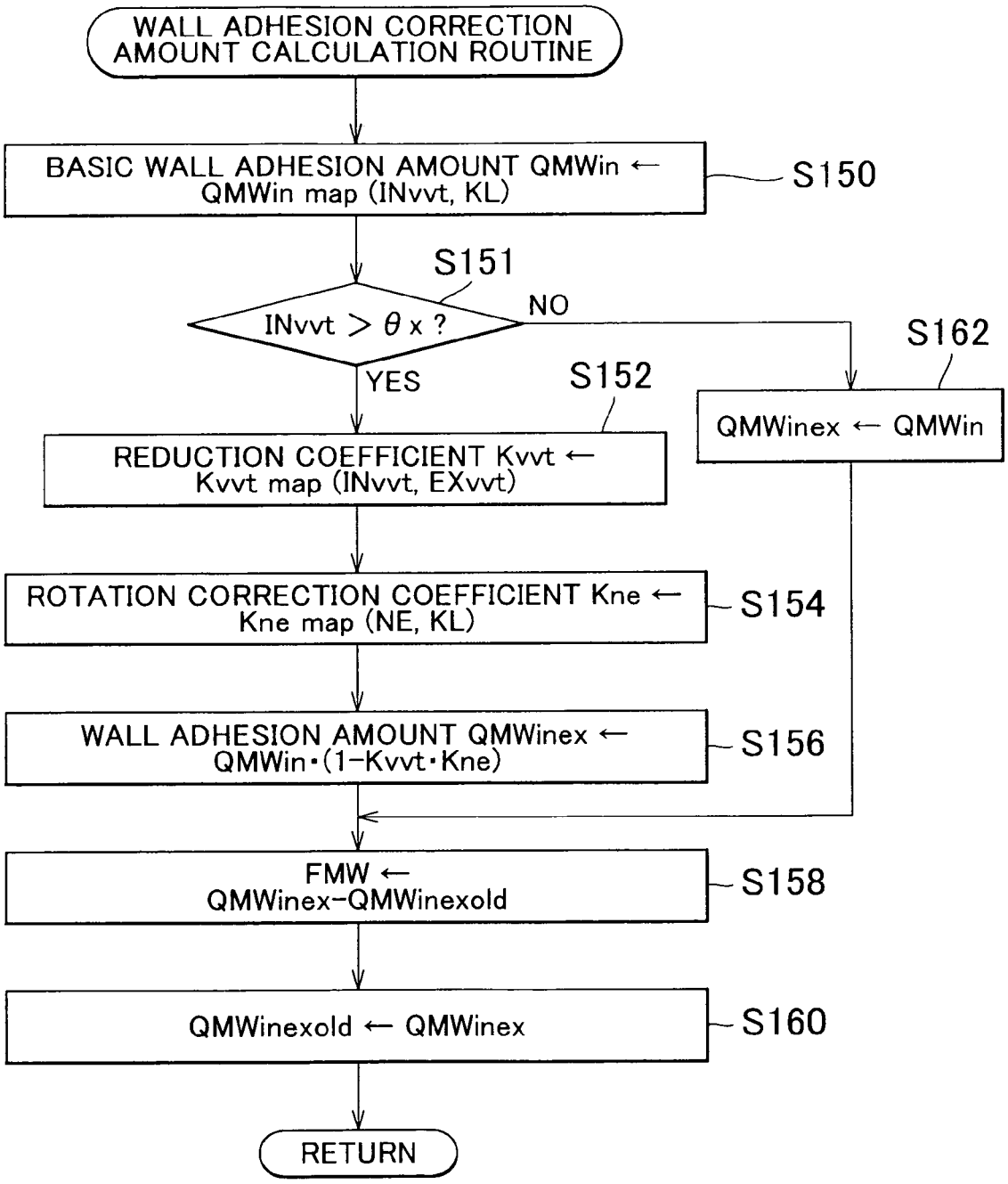
FIG. 7 illustrates the flowchart of a wall adhesion correction amount calculation routine in a control apparatus for an internal combustion engine according to a second embodiment of the invention.

FIG. 7 illustrates the flowchart of a wall adhesion correction amount calculation routine in the second embodiment. In this routine, only when the crank angle indicating the intake valve timing INvvt is greater than the boundary crank angle θx (INvvt>θx) (i.e., YES in step S151), the processes in step S152 and subsequent steps shown in FIG. 3 are executed. When the crank angle indicating the intake valve timing INvvt is equal to or less than the boundary crank angle θx (i.e., NO in step S151), the wall adhesion amount QMWinex is set to the basic wall adhesion amount QMWin (step S162). The wall adhesion correction amount calculation routine in the second embodiment is different from that in the first embodiment shown in FIG. 3 in this point.

In the first embodiment, in the region Ax and around the region Ax, the reduction coefficient Kvvt is approximately "0" even when the exhaust valve timing EXvvt is changed to the fullest extent. Therefore, in the region Ax and around the region Ax, the value in the parentheses in the right side of the equation (2) is approximately "1".

Meanwhile, in the second embodiment, in the region corresponding to the region Ax and around the region Ax, in the first embodiment, the calculation in the parentheses in the right side of the equation (2) is not performed, and the wall adhesion amount QMWinex is set to the basic wall adhesion amount QMWin (step S162). That is, in the region corresponding to the region Ax and around the region Ax, the change in the exhaust valve timing EXvvt is not taken into account.

Figure 3:
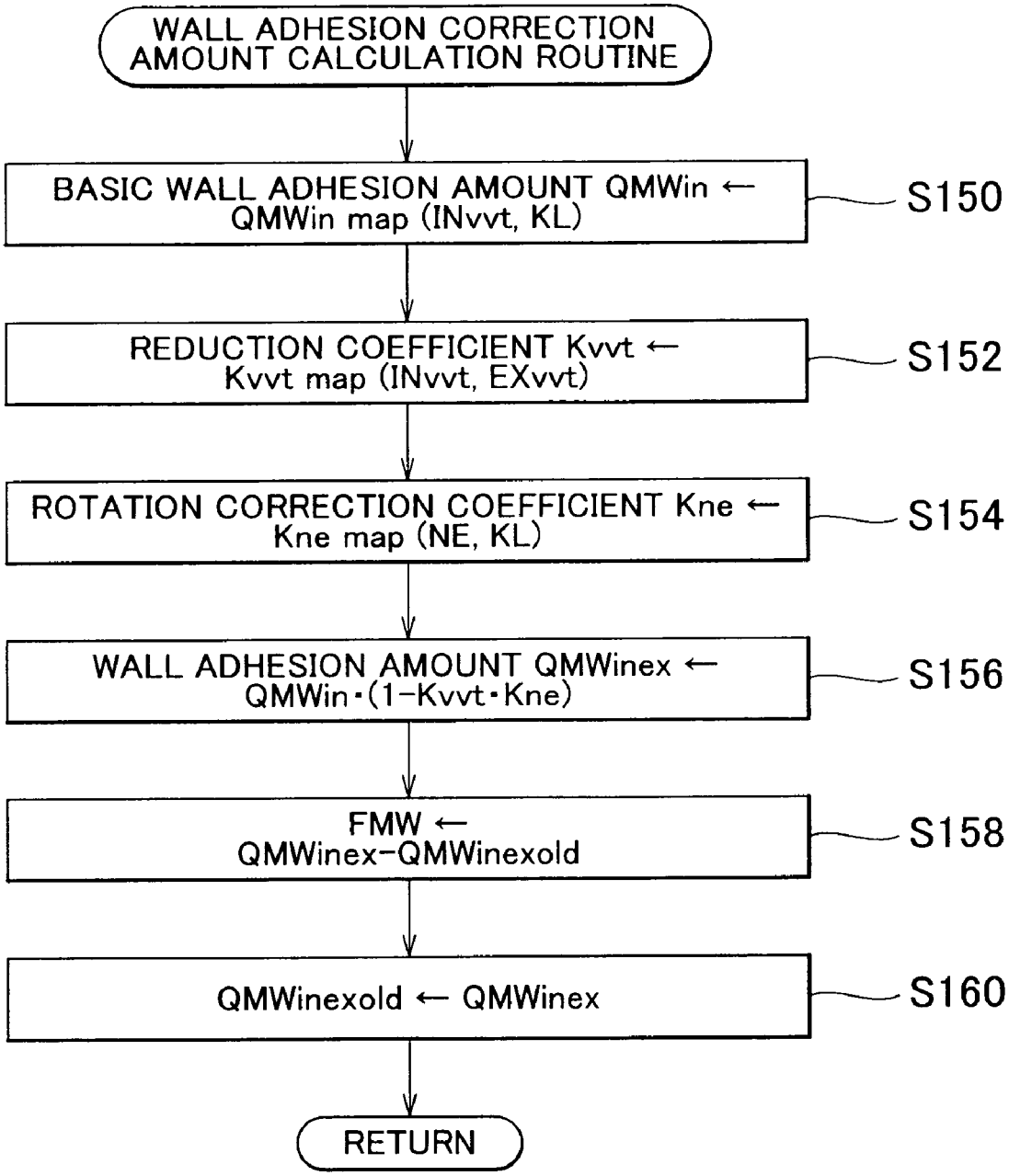
FIG. 3 illustrates the flowchart of a wall adhesion correction amount calculation routine according to the first embodiment.

The other processes are the same as those in the routine shown in FIG. 3. Therefore, the same processes are denoted by the same reference numerals. In the aforementioned routine, the region corresponding to the region Ax and around the region Ax is the same as the region Ax and around the region Ax in the first embodiment. However, the region corresponding to the region Ax and around the region Ax does not need to be the same as the region Ax and around the region Ax in the first embodiment. For example, the boundary crank angle θx may be set to a value less than 20 degrees.

In the aforementioned configuration, the processes in steps S150 to S162 in the wall adhesion correction amount calculation routine (FIG. 7) correspond to the processes executed by the calculation means according to the invention.

According to the second embodiment that has been described, the following effect can be obtained in addition to the effect that can be obtained according to the first embodiment.

The Kvvt map in the second embodiment does not need to include data concerning the region corresponding to the region Ax and around the region Ax in the first embodiment. Accordingly, the amount of data that needs to be stored in the ROM of the ECU 22 can be reduced, and the configuration of data can be simplified. With this simplified configuration, the appropriate wall adhesion amount QMWinex can be obtained, and the amount of fuel to be injected can be accurately controlled according to the change in the amount of fuel adhering to the wall surface of the intake port 2*a*.

A third embodiment of the invention will be described. In the third embodiment, the wall adhesion amount QMWinex is calculated according to an equation (4) described below in step S156 in the wall adhesion correction amount calculation routine in the first embodiment (FIG. 3) or in the wall adhesion correction amount calculation routine in the second embodiment (FIG. 7). The configuration in the third embodiment is the same as that in the first embodiment or the second embodiment, except that the equation (4) is used in step S156.

$$QMWinex \leftarrow QMWin(1-Kvvt \cdot Kne \cdot Kthw) \quad (4)$$

Figure 8:
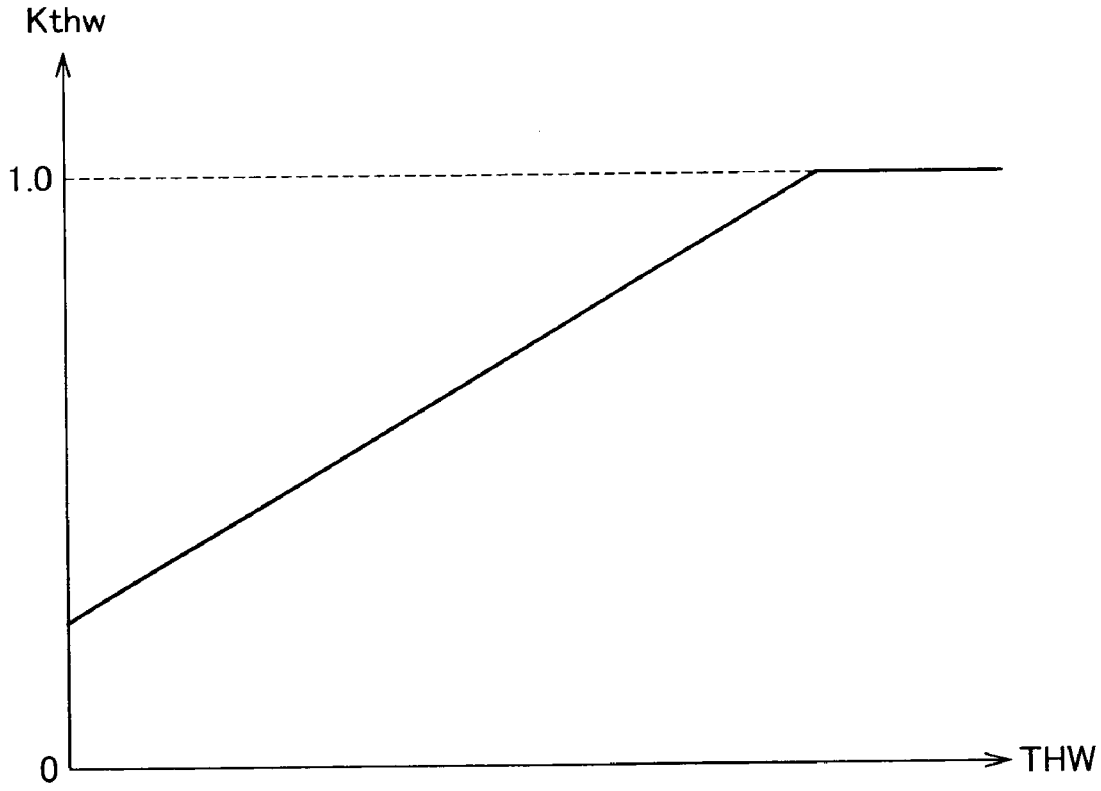
FIG. 8 illustrates a diagram explaining the configuration of a Kthw map in a control apparatus for an internal combustion engine according to a third embodiment of the invention.

The equation (4) is different from the equation (2) in that "Kvvt·Kne·Kthw" is used. That is, in the equation (4), a coolant temperature correction coefficient Kthw is used. The coolant temperature correction coefficient Kthw is calculated using a Kthw map in FIG. 8. As the engine coolant temperature THW increases, the amount of fuel adhering to the wall surface of the intake port 2*a* decreases. Therefore, in FIG. 8, the coolant temperature correction coefficient Kthw is set to be increased as the engine coolant temperature THW increases.

In the aforementioned configuration, the processes in steps S150 to S160 in the wall adhesion correction amount calculation routine (FIG. 3) or the processes in steps S150 to S162 in the wall adhesion correction amount calculation routine (FIG. 7) correspond to the processes executed by the calculation means according to the invention.

According to the third embodiment that has been described, the following effect can be obtained in addition to the effects that can be obtained according to the first embodiment or the second embodiment.

By correcting the reduction coefficient Kvvt according to the engine coolant temperature THW, the amount of fuel to be injected can be accurately controlled according to the change in the amount of fuel adhering to the wall surface of the intake port 2*a*.

Other embodiments of the invention will be described. In the first embodiment or the second embodiment, the reduction coefficient Kvvt is corrected using the rotation correction coefficient Kne as shown in the equation (2). However, the amount of fuel adhering to the wall surface of the intake port 2*a* may not be changed due to the changes in the engine rotational speed NE and the load factor KL in some types of engines or in some engine operating states. In this case, the rotation correction coefficient Kne does not need to be used. Alternatively, the reduction coefficient Kvvt may be corrected using only the engine rotational speed NE or the load factor KL, instead of the rotation correction coefficient Kne.

The equation (4) in the third embodiment may be changed in the same manner. That is, the reduction coefficient Kvvt may be corrected using only the coolant temperature correction coefficient Kthw. Alternatively, the reduction coefficient Kvvt may be corrected using the combination of the coolant temperature correction coefficient Kthw and a coefficient calculated based on the engine rotational speed NE or the load factor KL, instead of using the rotation correction coefficient Kne.

In addition, in some types of engines or in some engine operating states, a coefficient calculated based on the engine rotational speed NE and the engine coolant temperature THW may be used, instead of using the rotation correction coefficient Kne and the coolant temperature correction coefficient Kthw. Alternatively, a coefficient calculated based on the load factor KL and the engine coolant temperature THW may be used.

In the first to third embodiments of the invention, the intake air amount sensor 16 is used to detect the condition of intake air. Instead, the surge tank 12 may be provided with an intake air pressure sensor, and the condition of intake air may be detected using the pressure of intake air.

What is claimed is:

1. A control apparatus for an internal combustion engine, comprising:

a calculation portion which obtains a first index that indicates an amount of fuel adhering to a wall surface of an intake passage, using intake valve timing, based on a first relation that is set between the intake valve timing and the first index under a condition that exhaust valve timing is fixed;

obtains a correction value that reduces the first index, using the exhaust valve timing and the intake valve timing, based on a second relation that is set among the exhaust valve timing, the intake valve timing and the correction value under a condition that the exhaust valve timing is not fixed; and calculates a second index that indicates the amount of fuel adhering to the wall surface of the intake passage, by correcting the first index using the correction value, a control portion which controls an amount of fuel to be injected based on at least one of the first index and the second index.

2. The control apparatus for an internal combustion engine according to claim 1, wherein the calculation portion sets the second relation such that the correction value is equal to or less than a predetermined value in a case where a crank angle by which the intake valve timing is advanced with respect to a reference crank angle is in a predetermined range.

3. The control apparatus for an internal combustion engine according to claim 2, wherein the calculation portion sets a lower limit of the predetermined range to 0 degree, and sets an upper limit of the predetermined range to 20 degrees.

4. The control apparatus for an internal combustion engine according to claim 3, wherein the calculation portion corrects the correction value using a parameter other than the intake valve timing and the exhaust valve timing, which indicates an operating state of an internal combustion engine.

5. The control apparatus for an internal combustion engine according to claim 4, wherein the parameter includes at least one of a load of the internal combustion engine, a rotational speed of the internal combustion engine, and a temperature of coolant in the internal combustion engine.

6. The control apparatus for an internal combustion engine according to claim 2, wherein the calculation portion corrects the correction value using a parameter other than the intake valve timing and the exhaust valve timing, which indicates an operating state of an internal combustion engine.

7. The control apparatus for an internal combustion engine according to claim 6, wherein the parameter includes at least one of a load of the internal combustion engine, a rotational speed of the internal combustion engine, and a temperature of coolant in the internal combustion engine.

8. The control apparatus for an internal combustion engine according to claim 1, wherein the calculation portion does not calculate the second index, and uses the first index for controlling the amount of fuel to be injected in a case where a crank angle by which the intake valve timing is advanced with respect to a reference crank angle is in a predetermined range.

9. The control apparatus for an internal combustion engine according to claim 8, wherein the calculation portion sets a lower limit of the predetermined range to 0 degree, and sets an upper limit of the predetermined range to 20 degrees.

10. The control apparatus for an internal combustion engine according to claim 9, wherein the calculation portion corrects the correction value using a parameter other than the intake valve timing and the exhaust valve timing, which indicates an operating state of an internal combustion engine.

11. The control apparatus for an internal combustion engine according to claim 10, wherein the parameter includes at least one of a load of the internal combustion engine, a rotational speed of the internal combustion engine, and a temperature of coolant in the internal combustion engine.

12. The control apparatus for an internal combustion engine according to claim 8, wherein the calculation portion corrects the correction value using a parameter other than the intake valve timing and the exhaust valve timing, which indicates an operating state of an internal combustion engine.

13. The control apparatus for an internal combustion engine according to claim 12, wherein the parameter includes at least one of a load of the internal combustion engine, a rotational speed of the internal combustion engine, and a temperature of coolant in the internal combustion engine.

14. The control apparatus for an internal combustion engine according to claim 1, wherein the calculation portion corrects the correction value using a parameter other than the intake valve timing and the exhaust valve timing, which indicates an operating state of an internal combustion engine.

15. The control apparatus for an internal combustion engine according to claim 14, wherein the parameter includes at least one of a load of the internal combustion engine, a rotational speed of the internal combustion engine, and a temperature of coolant in the internal combustion engine.

* * * * *